United States Patent [19]

Betsui

[11] Patent Number: 5,037,336

[45] Date of Patent: Aug. 6, 1991

[54] ELECTRICAL CONNECTOR WITH TERMINAL RETENTION MEMBER

[75] Inventor: Kazuhisa Betsui, Tokyo, Japan

[73] Assignee: AMP Incorporated, Harrisburg, Pa.

[21] Appl. No.: 580,049

[22] Filed: Sep. 7, 1990

[30] Foreign Application Priority Data

Sep. 29, 1989 [JP] Japan ..... 1-253936

[51] Int. Cl.[5] ..... H01R 13/436

[52] U.S. Cl. ..... 439/752

[58] Field of Search ..... 439/595, 752, 733

[56] References Cited

U.S. PATENT DOCUMENTS

| | | | |
|---|---|---|---|
| 4,772,229 | 9/1988 | Nix et al. | 439/733 |
| 4,826,452 | 5/1989 | Sian et al. | 439/595 |
| 4,867,712 | 9/1989 | Kato et al. | 439/752 |
| 4,900,271 | 2/1990 | Colleran et al. | 439/595 |
| 4,946,398 | 8/1990 | Takenouchi et al. | 439/752 |

FOREIGN PATENT DOCUMENTS

| | | |
|---|---|---|
| 63-58470 | 4/1988 | Japan . |
| 2230391 | 10/1990 | United Kingdom . |

*Primary Examiner*—Gary F. Paumen

*Attorney, Agent, or Firm*—Adrian J. LaRue; Allan B. Osborne

[57] ABSTRACT

A connector (C) having a housing (10) and latching member (50) is disclosed. The housing (10) and latching member (50) include cooperating latching devices (61,21) for retaining the two (10,50) together in a temporary position and other latching devices (17,63) for retaining the two (10,50) in a final position. The connector further includes cooperating prevention means located on the housing and on the latching member for preventing the latching member from being moved to the final position until the prevention means is operated.

4 Claims, 10 Drawing Sheets

10
3A
3B
3C
C

ELECTRICAL CONNECTOR WITH TERMINAL RETENTION MEMBER

FIELD OF THE INVENTION

The present invention relates to an electrical connector, and more particularly to an electrical connector which is provided with a member which hooks onto an electric terminal which is inserted in the terminal accommodating chamber of a housing and which prevents the above-mentioned terminal from falling out either in the direction of insertion or in the opposite direction.

BACKGROUND OF THE INVENTION

This type of connector is well known and is described in Laid-Open [Japanese]Utility Model No. 6358470. In this utility model, an electrical connector is disclosed which is provided with a latching member (a spacer) which is used as a device which hooks onto electrical terminals which have been inserted respectively into multiple terminal accommodating chambers on a housing and which prevents the abovementioned terminals from falling out either in the direction of insertion or in the opposite direction. Specifically, the latching member is provided with a flexible latching arm which can be inserted into the housing. This latching member can be moved vis-a-vis the housing from a temporary retaining position to the regular retaining position. In the temporary retaining position of the latching member, the terminals can be inserted in individual terminal accommodating chambers An almost cone-shaped protruding hooking part hooks onto the cross-section of the latching arm which latches onto the inside of the terminal of the electrical contact part which is positioned at the intermediate part of the terminal which is inserted into each of the terminal accommodating chambers and functions to prevent the above-mentioned terminal from slipping out either in the direction of insertion or in the opposite direction.

Despite the above, the conventional technology which includes the connector described in the above-mentioned Laid-Open [Japanese]Utility Model No. 6358470 was not provided with a device for retaining the temporary retaining position of the latching member relative to the housing As a result, the latching member inadvertently moved to the housing side when the manufacturer of the connector shipped the connectors to the end user while the latching part was temporarily retained in the housing. This also happened when the end user handled the connectors When this occurred, the electrical terminal could no longer be incorporated into the housing and the latching member had to be returned to the temporary retaining position. This was extremely troublesome and the reduced the efficiency of incorporating the electrical terminal into the housing as well as other operations.

Incidentally, this type of connector is built so that the electrical connector is incorporated into the housing at the temporary retaining position, is hooked onto the terminal accommodating chamber at the regular retaining position so that it cannot move and cannot be incorporated into the housing at the regular retaining position.

Therefore, the present invention deals with the problem of preventing the latching member from moving inadvertently from the temporary retaining position to the regular retaining position.

It is an object of the present invention to provide an electrical connector which has the following characteristics. It is an electrical connector which is equipped with (a) an insulated housing which is equipped with a latching lever when multiple electric terminal accommodating chambers hook onto the insulated housing of another connector and (b) an insulated latching member which is equipped with a latching arm which is inserted into the above-mentioned accommodating chamber which is used to latch onto the electrical terminal which is accommodated in the above-mentioned accommodating chamber. The above-mentioned housing and the above-mentioned latching member are equipped with a first device which temporarily retains the above-mentioned latching member in the above-mentioned housing and a second latching device which is retained permanently when the above-mentioned latching member moves from the temporary latching position to the side of the above-mentioned housing.

The above-mentioned latching lever and the above-mentioned latching member are equipped with a third latching device. This third latching device is hooked on so that the above-mentioned latching member is prevented from moving from the above-mentioned temporary retaining position to the above-mentioned regular retaining position Meanwhile, it is released by activating the above-mentioned latching lever so that the above-mentioned latching member can move to the regular latching position.

SUMMARY OF THE INVENTION

According to the present invention, a connector is provided having a housing and latching member for retaining terminals in the housing. Latching devices on the housing and latching member hold the two together in a temporary position and also in a final position. A third latching device permits the latching member to enter the final position at the appropriate time.

BRIEF DESCRIPTION OF THE INVENTION

DESCRIPTION OF THE INVENTION

Figure 1:
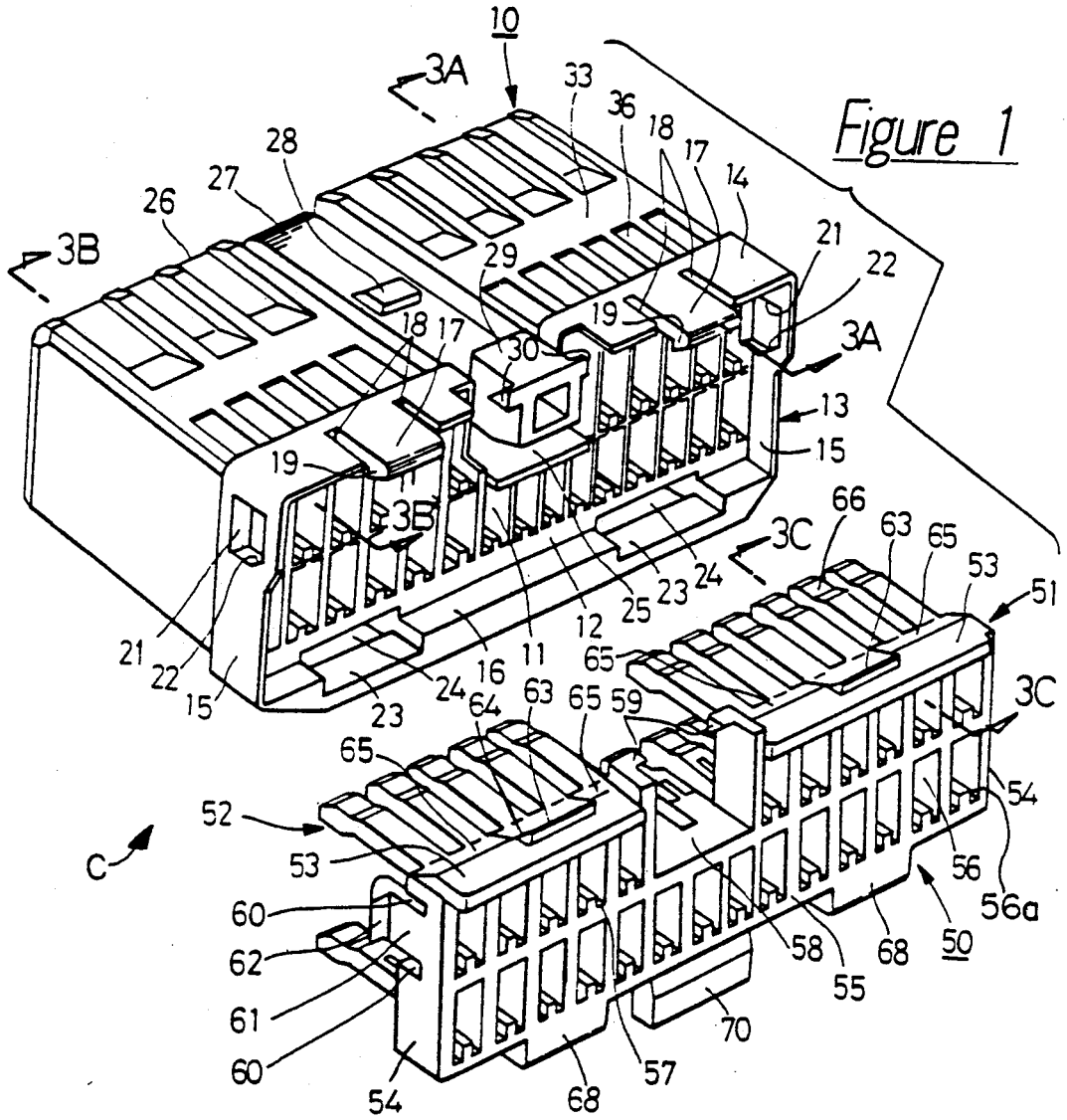
FIG. 1 is a perspective view of the housing and the latching member when they are separated from each other.
Figure 2:
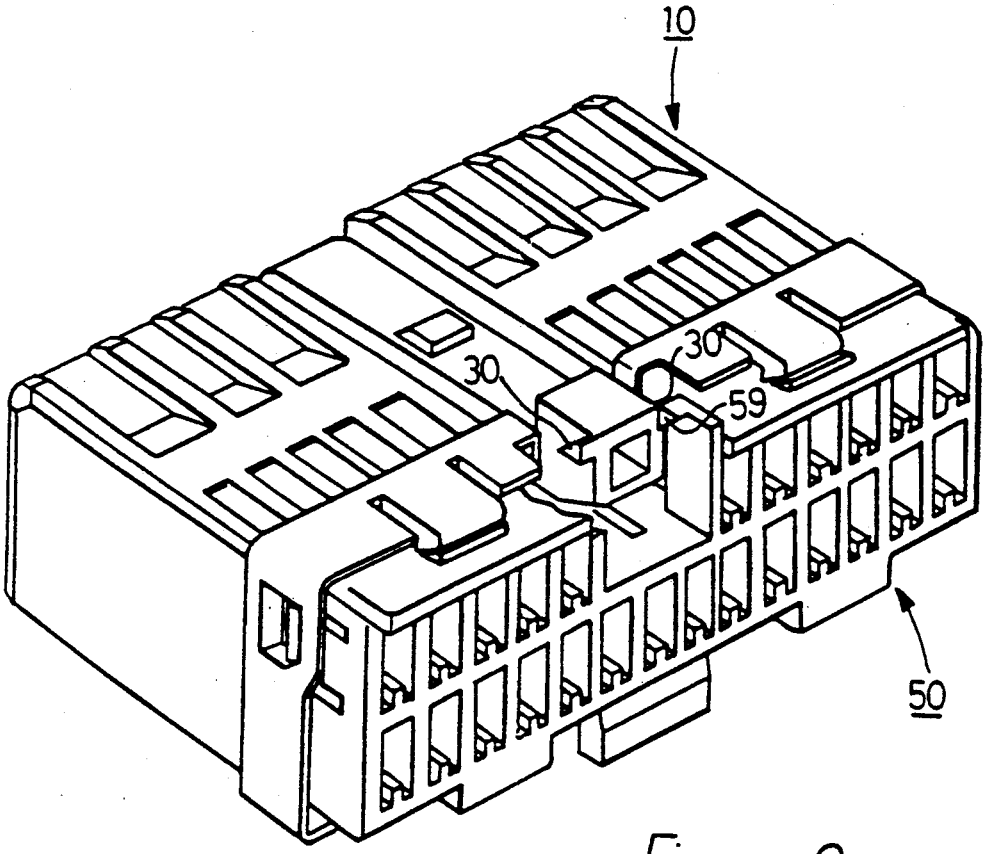
FIG. 2 is a perspective view of the latching member when it is temporarily retained by the housing.
Figure 3A:
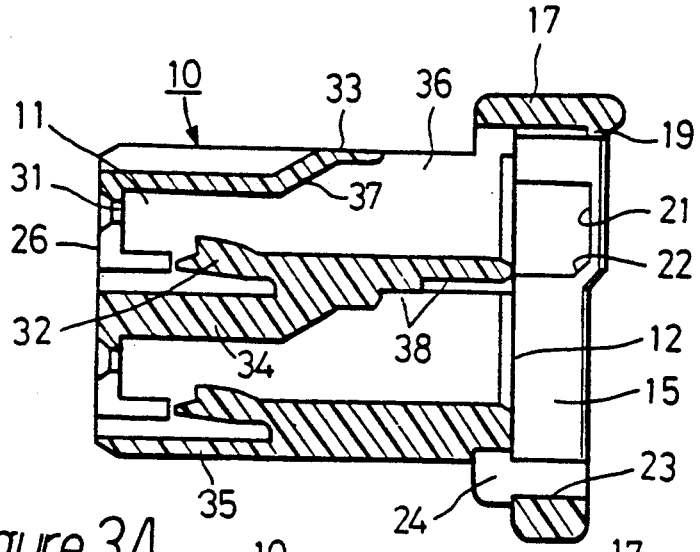
FIG. 3A is a sectional view taken along line 3A--3A in FIG. 1.
Figure 3B:
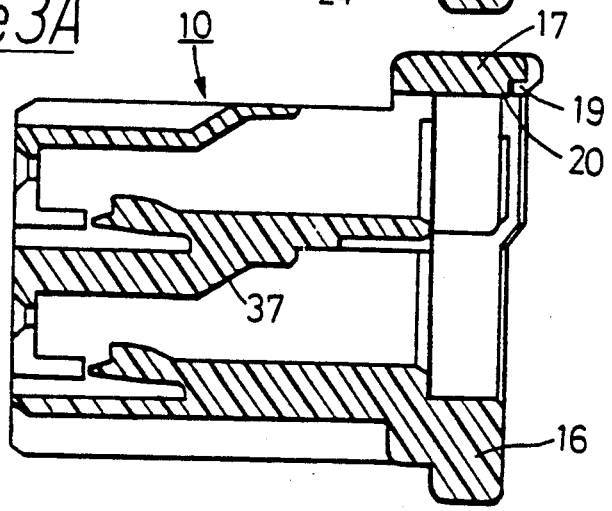
FIG. 3B is a sectional view taken along line 3B--3B in FIG. 1.

The connector C in FIG. 1 includes insulated housing 10 which is made of plastic. Housing 10 extends from rear end 12 to front end 26 and is equipped with multiple terminal accommodating chambers 11 which are arrayed horizontally and vertically. Frame part 13 which includes the rear end surface of housing 10 extends and juts out Frame part 13 is made up of upper side part 14, dual side part 15 and lower side part 16. An elastic latching part 17, defined by slits 18, is located on both sides of upper side part 14 and this latching part is equipped with a hook 19 which faces downward. It is equipped with contact part 20 (FIG. 3B) on the lower surface of upper side part 14 on both sides of resilient latching part 17. Latching hole 21 which is equipped with inclined edge 22 is formed on both side parts 15. Depressed groove 23 is formed on both sides of lower side part 16 and path 24 is formed on the angle which intersects with the above-mentioned depressed groove and rear end 12. Depressed groove 25 is formed on the wall of the upper surface of housing 10. Elastic latching lever 27 which continues along front end 26 and extends toward rear end 12 is positioned in the above-mentioned depressed groove. The above-mentioned lever is equipped with latching protrusion 28 which is located at the center of the upper surface and pressing part 29 which is located on the side of rear end 12. Triangular latching protrusions 30 whose upper surface is inclined, juts out from both sides of pressing part 29. Latching protrusion 28 hooks onto the latching part of the housing (not indicated in diagram) of the other connector which is interdependent with housing 10. Throughholes 31 (FIG. 3A) which correspond with each of the terminal accommodating chambers into which the male terminals of the other connector mentioned above are inserted is formed on front end 26. As FIG. 3A indicates, elastic lance 32 which juts out from center partition part 34 and from lower surface wall 35 is located so that it is level with housing 10. A stripshaped groove which guides and brushes against a stabilizer (not shown) which is equipped with terminals on both sides of the lower surface is formed on the lower bottom of the terminal accommodating chamber. Window hole 36 is formed near both upper side part 14 and upper surface wall 33 and inclined part 37 is formed close to the center of the above-mentioned upper surface wall. The same type of inclined surface part 37 is formed on center partition part 34 and elevated surface part 38 is formed on the side of rear end 12 which is continuous to the above-mentioned inclined surface part.

Figure 3C:
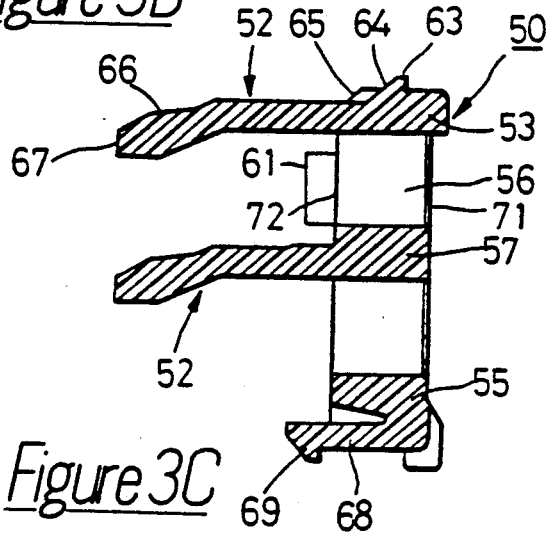
FIG. 3C is a sectional view taken along line 3C--3C in FIG. 1.

In FIG. 1, the connector C further includes insulated latching member 50 which is made of plastic material. Latching part 50 is made up of frame part 51 and latching arm group 52. Frame part 51 is made up of upper side part 53, dual side part 54 and lower side part 55 and is equipped with several cavities 56 which correspond to the terminal accommodating chambers 11 of housing 10. The latching arm 52 extends from the upper side part 53 and horizontal center partition part 57. Depressed part 58 which fits onto the outside circumference of depressed groove 25 of housing 10 is formed on the center of the upper surface of upper side part 53. Triangular latching protrusions 59 which cooperates with latching protrusion 30 of latching lever 27 protrudes from both sides of depressed part 58. The lower surface of latching protrusions 59 is inclined. Elastic latching part 61 defined by slits 60 is provided, on dual side part 54. The latching part 61 is equipped with a hook 62 which faces outward. Latching protrusions 63 are located on upper side part 53 at a specific interval. The latching protrusions 63 is equipped with inclined surface 64 (FIG. 3 C). Inclined surface part 65 which brushes against contact part 20 of housing 10 is formed on the inside edge of the above-mentioned upper side part 53 on both sides of latching protrusions 63. The front end part 66 of each of the latching arms 52 is bent downward and its upper surface is formed on the bottom of the raised surface. Elastic latching part 68 (FIG. 3C), provided on the lower surface of both sides of lower side part 55, brushes against depressed groove 23 on the housing and passes through path 24. This latching part is equipped with hook 69 which faces downward Stopper 70 is placed between both elastic latching parts 68. Parallel grooves 56a which guides a stabilizer equipped with terminals on both lower sides is formed on the bottom surface of cavities 56.

Next, we shall refer to FIGS. 4A through 4E, FIGS. 5A through 5E, FIG. 6 and FIG. 7 and to FIGS. 8A through 8D.

Figure 4A:
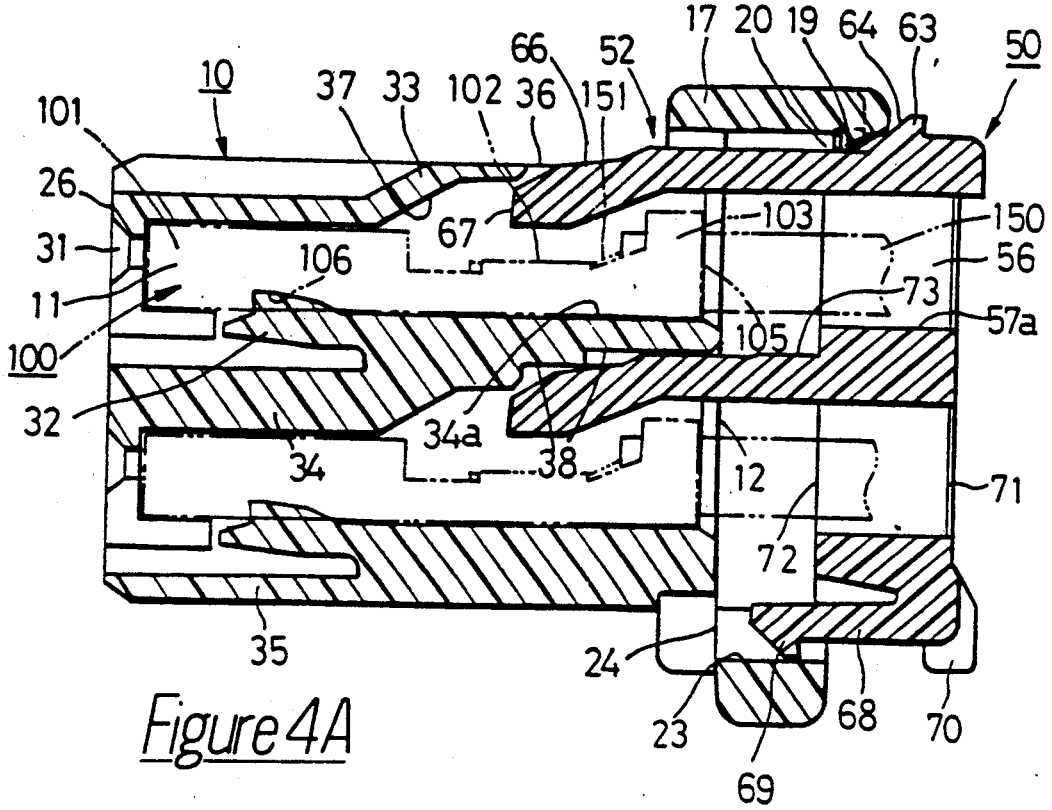
FIGS. 4A through 4E are sectional views of the latching member when it is being moved toward the housing from the temporary retaining position to the regular retaining position.
Figure 4B:
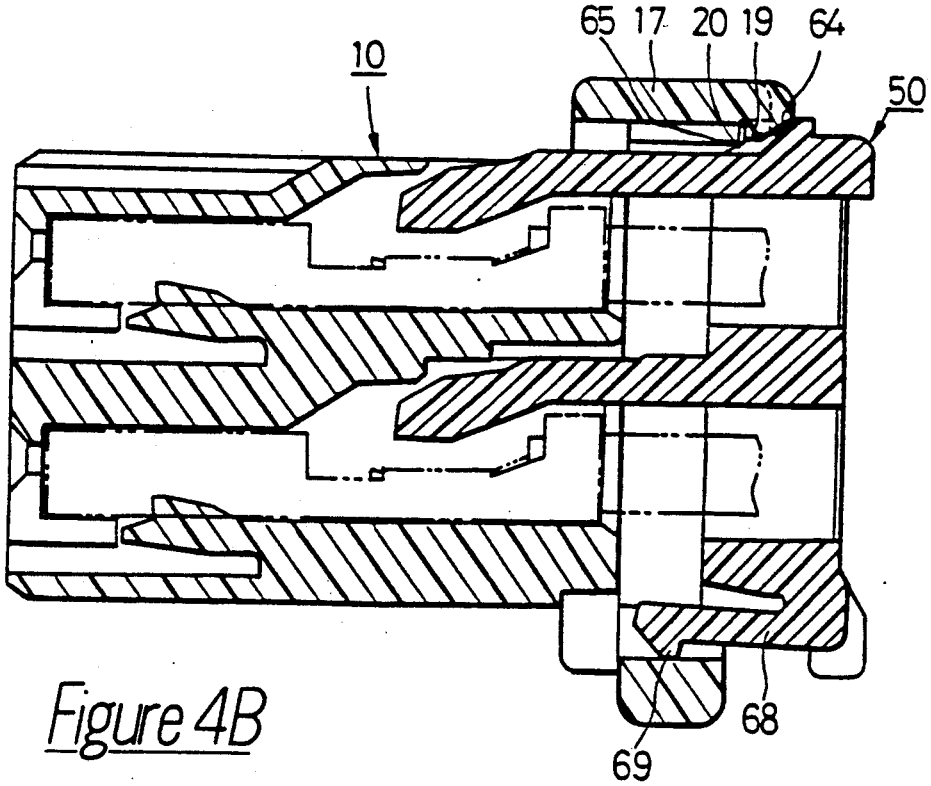
Figure 4C:
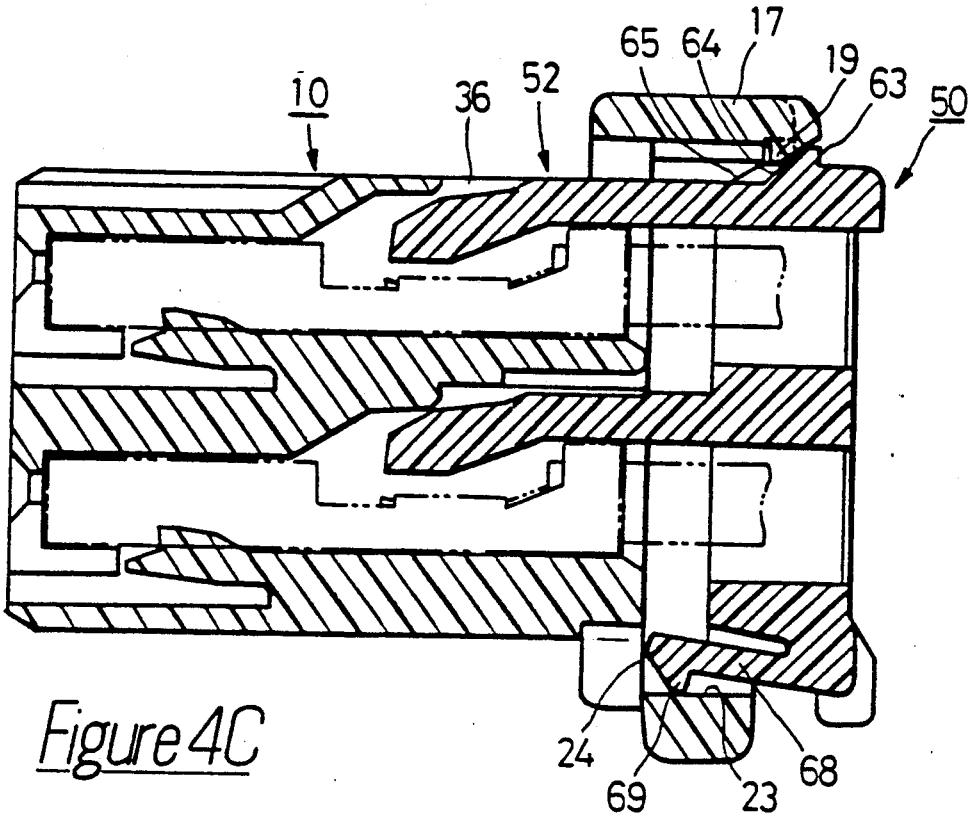
Figure 4D:
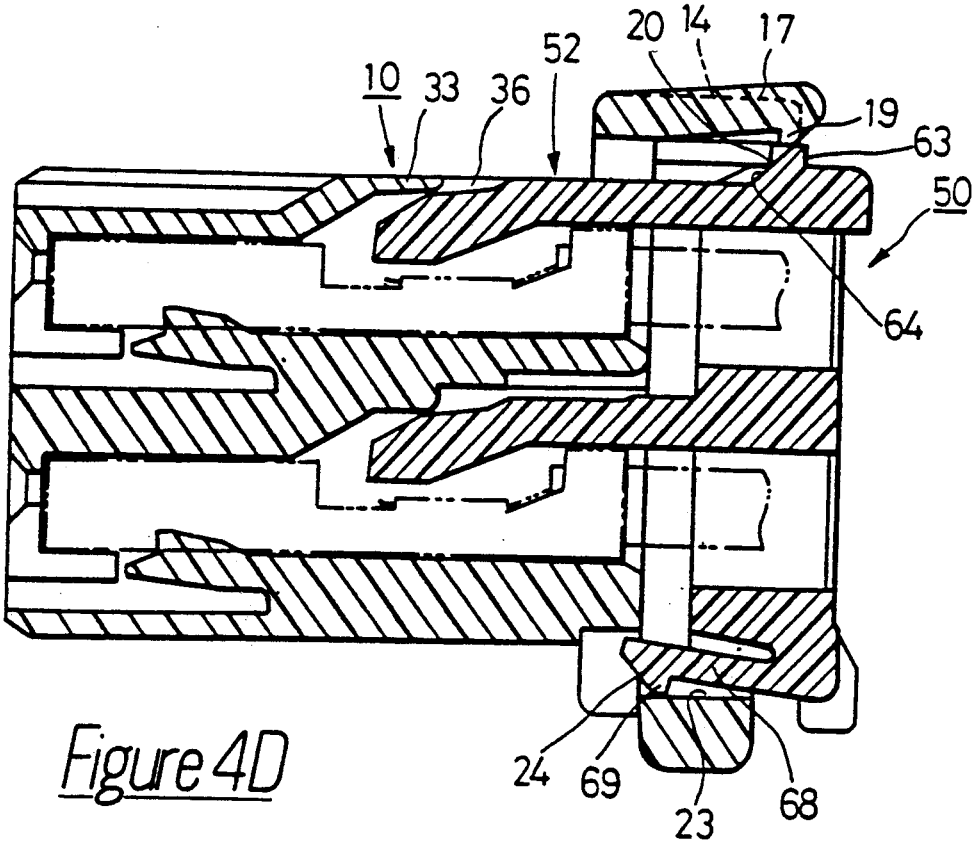
Figure 4E:
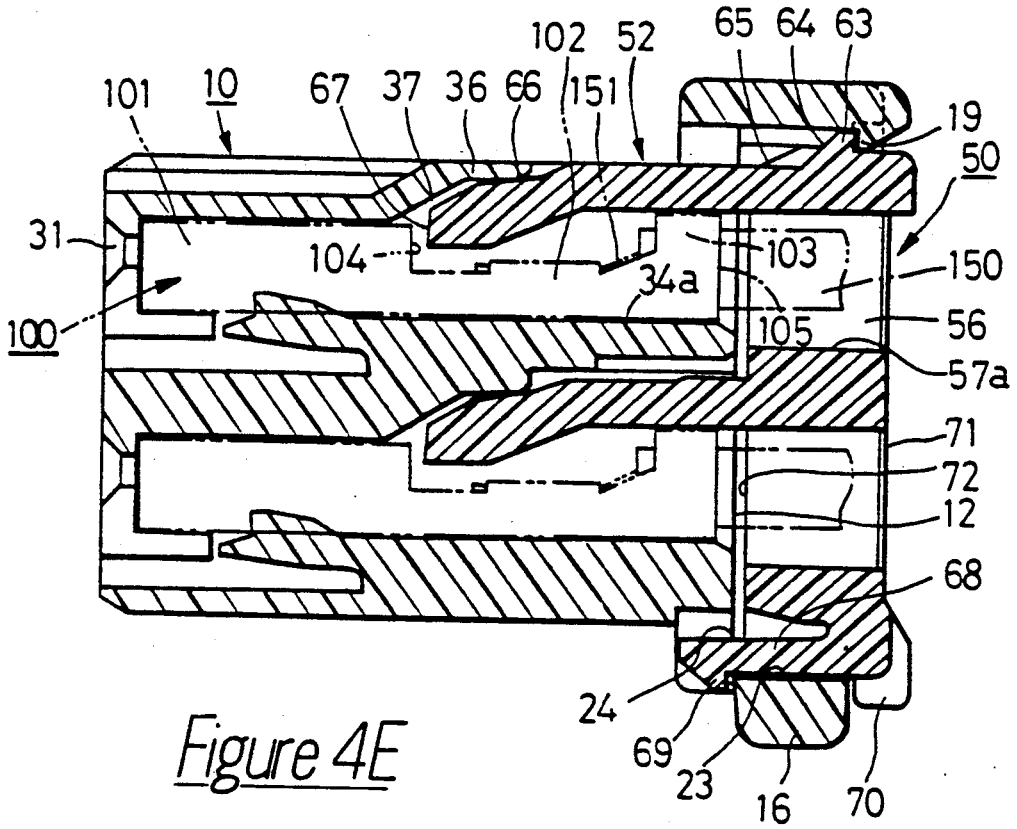
Figure 5A:
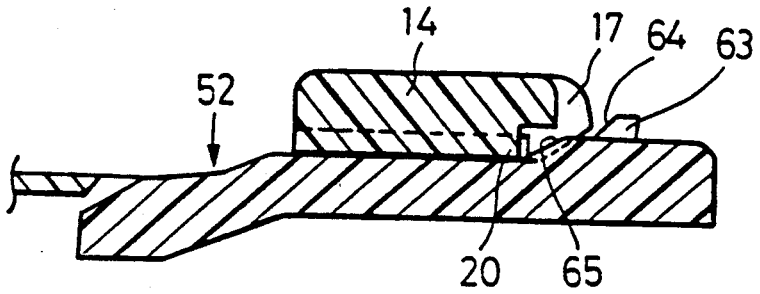
FIGS. 5A through 5E are partial expanded sectional views of the latching member when it is being moved toward the housing from the temporary retaining position to the regular retaining position at a position that is different from that in FIGS. 4A through 4E.
Figure 5B:
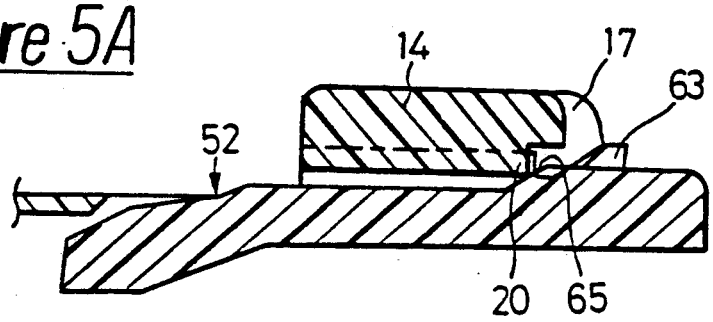
Figure 5C:
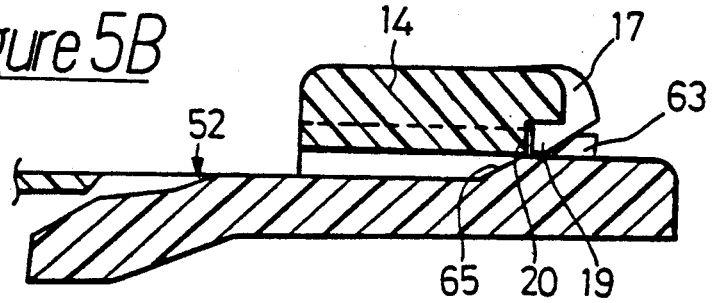
Figure 5D:
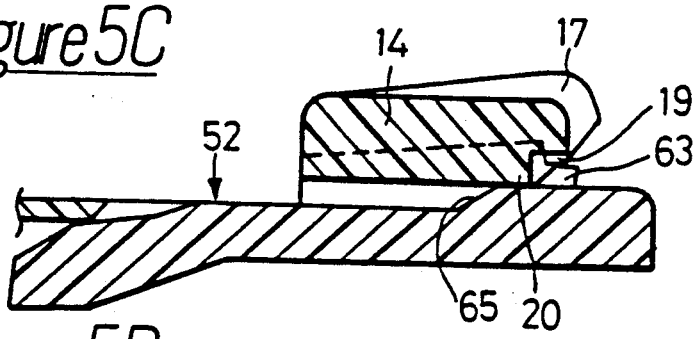
Figure 5E:
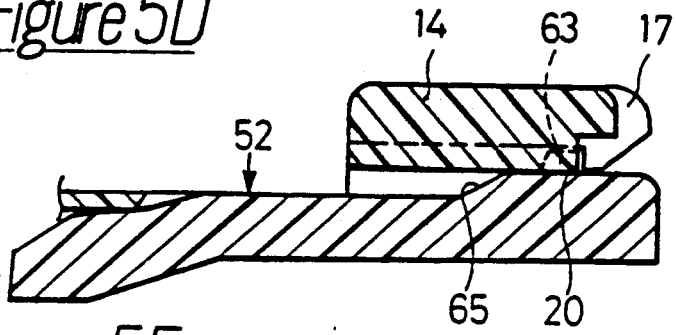
Figure 6:
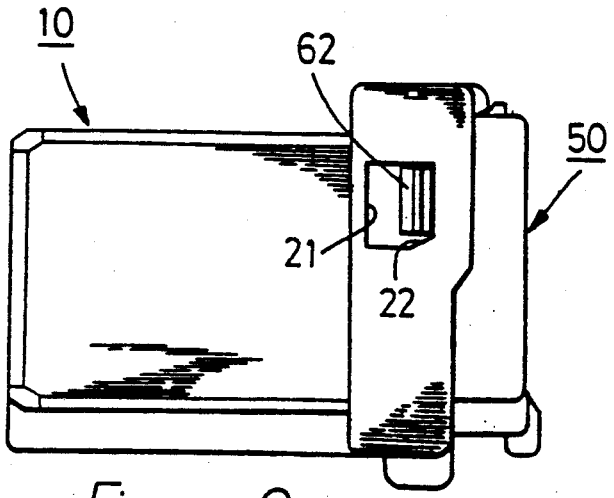
FIG. 6 and FIG. 7 are side views of the housing and the latching member both at the above-mentioned temporary retaining position and at the regular retaining position.
Figure 7:
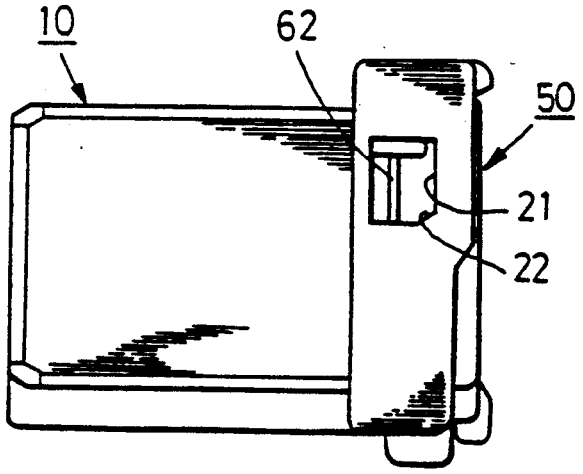
Figure 8A:
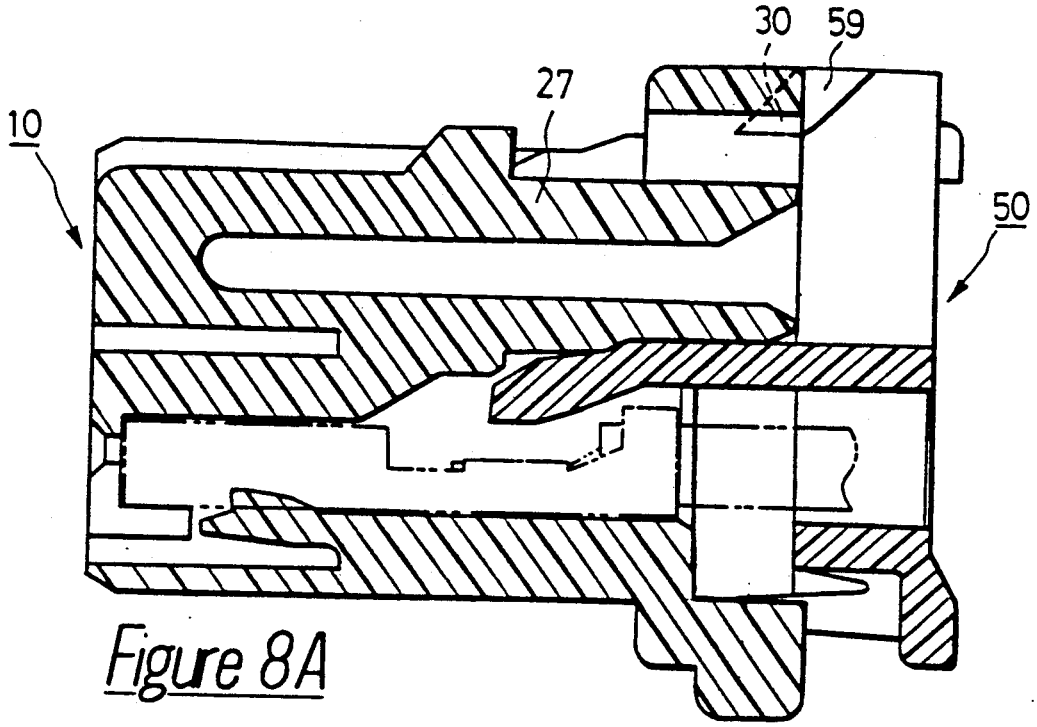
FIGS. 8A through 8D are sectional views of the housing and the latching member as they are moved from the temporary retaining position to the regular retaining position.

First latching arm 52 of latching member 50 is inserted in the terminal accommodating chamber 11 of housing 10 and latching member 50 is retained temporarily in housing 10, as is indicated in FIG. 4A and FIG. 5A. When latching member 50 reaches the temporary retaining position, protrusion 62 (FIG. 1) of resilient latching part 61 which is positioned at both side surfaces 54 of latching member 50 makes resilient contact with the inside surface of both side parts 15 of housing 10, brushes against them and is hooked into latching hole 21 which is positioned at both side parts 15. This latching action is sensed by the operator when latching part 50 has moved toward the temporary retaining position. The opening of terminal accommodating chamber 11 on side 12 of the rear end of housing 10 and the opening on both front and rear end surfaces of cavity 56 of latching member 50 are aligned. For example, when the terminal accommodating chamber 11 and cavity 56 which are positioned on the upper stage are examined, the bottom surface 34A of terminal accommodating chamber 11 and bottom surface 57A of cavity 56 are positioned so that they are level. Latching protrusion 59 strikes against latching protrusion 30 and hooks onto it at this temporary retaining position, as indicated in FIG. 8A As a result, it cannot move toward the housing side even if the latching member 50 is pressed toward housing 10.

Male terminal 100 passes through cavity 56 from the side of rear end 71 of latching member 50 and is inserted into terminal accommodating chamber 11. Terminal 100 is equipped with: electrical contact part 101 which receives the male terminal (not shown) of the other connector, crimping part 102 for exposed wire part 151 of electric wire 150, crimping part 103 for the covered part of electric wire 150 and concave part 106 on the lower surface of connection part 101. These terminals 100 are inserted into terminal accommodating chamber 11 by camming the resilient lance 32 and brushing against it. When terminal 100 brushes against a specific position, resilient lance 32 hooks onto the concave part 106 through its resilient force. The latching part 17 and contact end 20 of housing 10 do not brush against the inclined surface parts 64 and 65 of latching member 50 at the temporary retaining position, however, hook 69 of latching part 68 is positioned in groove 23 of housing 10.

Figure 8B:
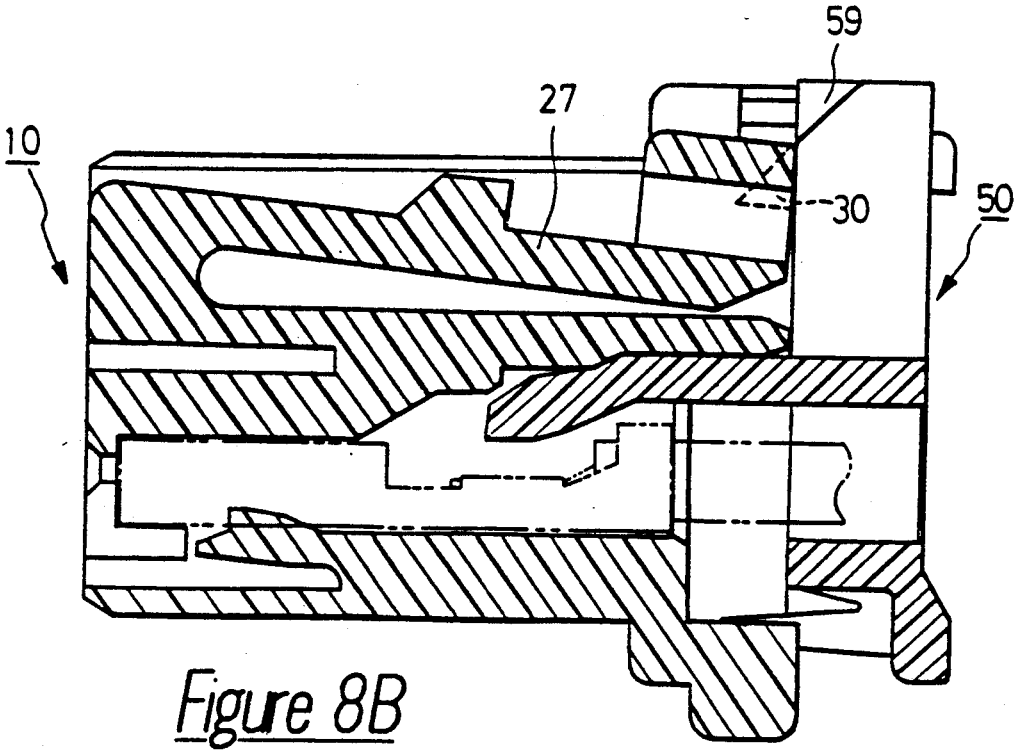
Figure 8C:
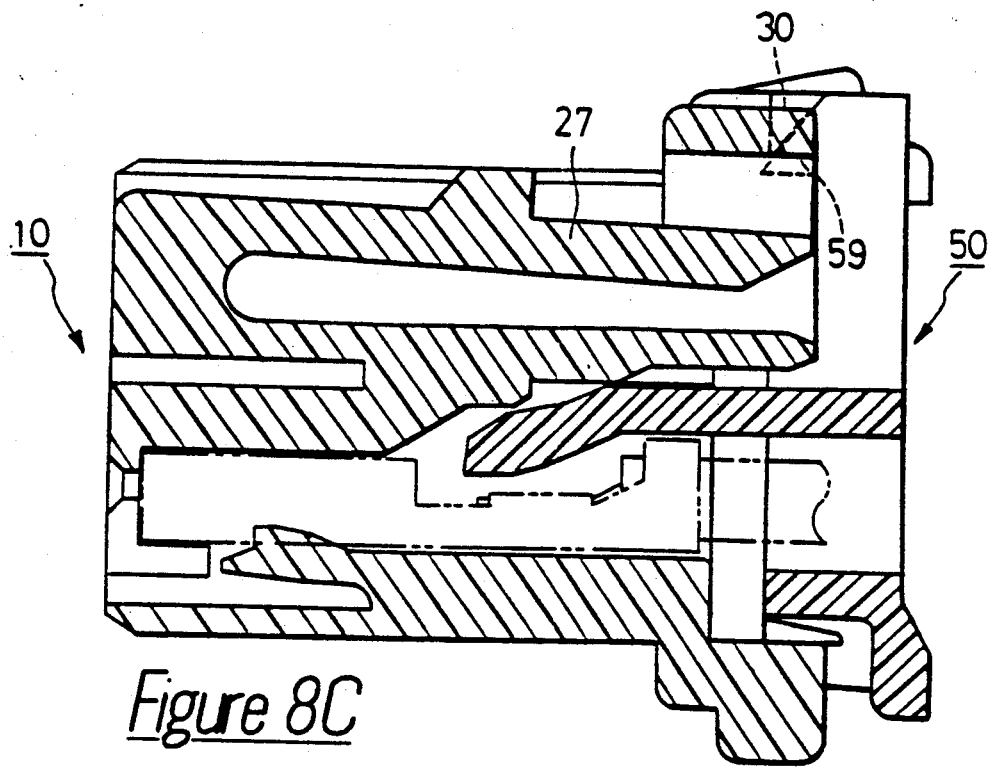
Figure 8D:
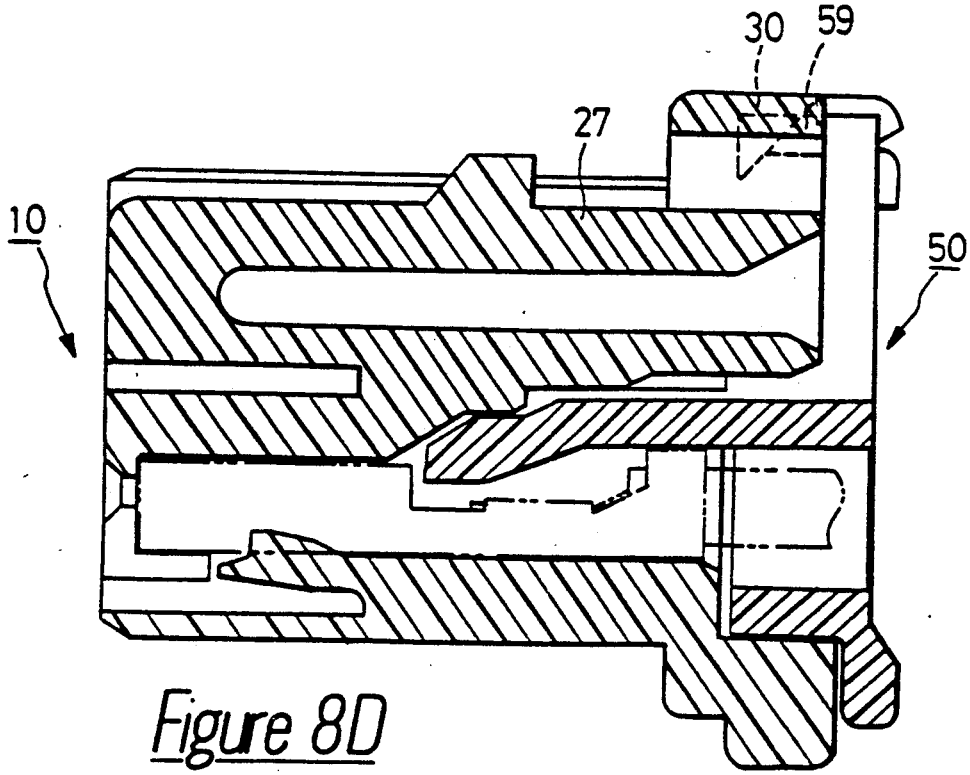

As FIG. 8B and FIG. 8C indicate, latching lever 27 is pressed down and the hooking action of latching protrusion 59 relative to latching protrusion 30 is released As FIGS. 4B through 4D and FIGS. 5B through 5D indicate, when attempts are made once more to insert the latching member 50 into housing 10—that is, inserting latching arm 52 into the terminal accommodating chamber 11—the hook 62 (FIG. 1, FIG. 6) of latching part 61 which is positioned on both side surfaces of the above-mentioned latching member brushes against inclined edge 22 of latching hole 21 and makes contact with the lower edge of the above-mentioned latching hole. At the same time, the contact end 20 of latching part 17 brushes against inclined surface part 65 of latching member 50, goes up to the top of the latching member so that the above-mentioned latching member descends while going forward. In this process, hook 19 of latching part 17 brushes against inclined surface part 64 of latching protrusion 63 of latching member 50, goes up to the top of the above-mentioned protrusion, becomes deformed and faces upward. In this process, latching part 68 brushes against depressed groove 23 as is being deformed As FIG. 4E and FIG. 5E indicate, when one attempts to insert latching arm 52 into terminal accommodating chamber 11, the contact end 20 brushes against the top of latching member 50. At the same time, hook 19 of latching part 17 goes past the latching protrusion 63 and hooks onto it. At the same time, hook 69 of elastic latching part 68 passes through path 24, falls toward the front surface (inside surface) of lower side part 16, regains its original shape from the above-mentioned deformed shape and hooks onto part of the above-mentioned lower part (regular position). At this time, hook 62 of latching part 61 moves toward the front edge of latching hole 21 and makes contact with it (refer to FIG. 7). At this time, latching lever 27 returns to its original position so that latching protrusion 30 and latching protrusion 59 of latching member 50 face each other, as is indicated in FIG. 8D.

When latching member 50 has been placed in housing 10 in the regular position—i e., when the latching arm 52 has been inserted all the way into terminal accommodating chamber 11—, the front end 67 of latching arm 52 approaches inside end 104 (FIG. 4E) of electrical contact part 101 of terminal 100 and faces it. As a result, terminal 100 is prevented from slipping out either in the direction of insertion or in the opposite direction by front end 67 of latching arm 52. The front side part 72 of the frame of latching member 50 approaches the rear end surface 12 of the housing at this time. At the same time, cavities 56 drop down from the initial level position with terminal accommodation chamber 11.

As can be seen from FIGS. 4A through 4E, window hole 36 and inclined surface part 37 are provided on the upper surface wall 33 of housing 10 and inclined part 37 and depressed part 38 on the raised part are provided on center partition part 34 while the front edge 67 of latching arm 52 is bent downwards and its upper surface engages the bottom surface of the raised part as latching arm 52 moves into terminal accommodating chamber 11 and its upper surface is not forced to make contact with the inside surface of upper surface wall 33 and the lower inside surface of center partition part 34 which forms the upper surface part of terminal accommodating chamber 11 while latching arm 52 is being inserted into the terminal chamber 11.

As can be seen from the above, the terminal 100 is inserted into the terminal accommodating chamber 11 of housing 10. At the same time, the latching member 50 is completely inserted into the above-mentioned housing and the other connector (not shown) fits into connector C of the present invention which has been assembled. When this is fitted in, the latching part (not shown) of the other connector presses in the latching lever 27 of connector C and goes past latching protrusion 28 and hooks onto this. At the same time, the electrical contact part of the male terminal (not shown) of the other connector is inserted into and makes contact with electrical contact part 101 of male terminal 100 of connector C which connects both connectors electrically. Both connectors are separated by pressing the latching lever 27 of connector C with pressing part 29 and unhooking them as described previously.

In the present invention, housing 10 is equipped with latching lever 27 for the housing of the other connector. As long as it is a connector/housing which has a temporary retaining and regular retaining structure for housing 10 of latching member 50, it can be applied as well to a connector/housing which has another temporary retaining and regular retaining structure, no matter what the temporary retaining structure and regular retaining structure are. By no means is it restricted to the temporary retaining structure and the regular retaining structure shown in connector C.

If the electrical connector in the present invention is used, the latching member can be prevented from inadvertently moving from the temporary retaining position to the regular retaining position since it is equipped with a third latching device which prevents the latching member from moving towards the housing when the latching member is at the temporary retaining position relative to the housing Moreover, unhooking is carried out with the third latching device at the temporary retaining position by activating the latching lever. The latching member is moved toward the side of the housing and can be placed in the regular retaining position.

I claim:

1. An electrical connector, comprising:

a dielectric housing having terminal-receiving passageways for receiving electrical terminals therein;

a terminal latching member having latching arms;

first latching means on said housing and said terminal latching member latching said terminal latching member to said housing at a first position with said latching arms extending along said terminal-receiving passageways so that the electrical terminals can be positioned in said terminal-receiving passageways;

second latching means on said housing and said terminal latching member for latching said terminal latching member on said housing at a second position with said latching arms being positioned at a latching position latching the electrical terminals inn the passageways; and cooperating prevention means located on said housing and said terminal latching member intermediate of and independent of said first and second latching means for preventing said terminal latching member from being moved to said second position until said prevention means is operated whereby said terminal latching member can be moved to said second position.

2. An electrical connector as claimed in claim 1, wherein said prevention means located on said housing is moved downwardly as said terminal latching member is moved to said second position.

3. An electrical connector as claimed in claim 1, wherein said prevention means includes a housing latching lever having first protrusions thereon and second protrusions on said terminal latching member.

4. An electrical connector as claimed in claim 3, wherein said protrusions have a triangular configuration.

* * * * *